US005613609A

United States Patent [19]

Hamilton et al.

[11] Patent Number: 5,613,609

[45] Date of Patent: Mar. 25, 1997

[54] DUAL CHAMBER-CHILD RESISTANT BLISTER PACKAGE

[75] Inventors: Peter W. Hamilton, Cincinnati; Geneva G. Otten, Loveland, both of Ohio; Del M. Thornock, Concord, Calif.

[73] Assignee: The Procter & Gamble Company, Cincinnati, Ohio

[21] Appl. No.: 369,856

[22] Filed: Jan. 6, 1995

Related U.S. Application Data

[63] Continuation of Ser. No. 69,309, May 28, 1993, abandoned.

[51] Int. Cl.[6] ..... B65D 83/04

[52] U.S. Cl. ..... 206/531; 206/532; 206/538; 221/302

[58] Field of Search ..... 206/531, 532, 206/534.1, 538, 469, 461; 222/107, 541; 221/302, 89, 69

[56] References Cited

U.S. PATENT DOCUMENTS

| | | | |
|---|---|---|---|
| D. 237,864 | 12/1975 | Meierloefer | 206/461 X |
| 3,207,299 | 9/1965 | Sparles | 206/532 |
| 3,809,220 | 5/1974 | Arcudi . | |
| 3,809,221 | 5/1974 | Compere . | |
| 3,835,995 | 9/1974 | Haines . | |
| 3,872,970 | 3/1975 | Edison . | |
| 3,895,737 | 7/1975 | Phillips . | |
| 3,912,081 | 10/1975 | Haines et al. . | |
| 3,924,746 | 12/1975 | Haines . | |
| 3,941,248 | 3/1976 | Moser et al. . | |
| 3,948,394 | 4/1976 | Hellstrom . | |
| 4,011,949 | 3/1977 | Braber et al. . | |
| 4,125,190 | 11/1978 | Davie, Jr. et al. . | |
| 4,231,477 | 11/1980 | De Felice . | |
| 4,298,125 | 11/1981 | Berghahn et al. . | |
| 4,371,080 | 2/1983 | Haines . | |
| 4,398,634 | 8/1983 | McClosky . | |
| 4,398,635 | 8/1983 | Hirt . | |
| 4,485,915 | 12/1984 | Berghahn . | |
| 4,506,789 | 3/1985 | Dlugosz . | |
| 4,511,032 | 4/1985 | Bush . | |
| 4,537,312 | 8/1985 | Intini . | |
| 5,172,812 | 12/1992 | Wharton et al. | 206/531 |

FOREIGN PATENT DOCUMENTS

| | | | |
|---|---|---|---|
| 2403948 | 4/1979 | France | B65D 75/34 |
| 8401556 | 4/1984 | WIPO | B65D 75/34 |

*Primary Examiner*—Bryon P. Gehman
*Attorney, Agent, or Firm*—Michael E. Hilton; John M. Howell; Daniel F. Nesbitt

[57] ABSTRACT

A dual chamber-child-resistant blister package is provided. The blisters of the package include a storage chamber and a discharge chamber. In addition, the blister includes restraint means for preventing the medicament from moving from the storage chamber to the discharge chamber until a predetermined force is applied to the blister package. The medicament may not be dispensed directly from the storage chamber, since a nonrupturable layer is located adjacent the storage chamber of the blister. The nonrupturable layer includes an opening, or a mechanism such as a score line for forming and opening) through which the medicament can pass adjacent the discharge chamber. A rupturable layer is also provided to seal the medicament within the blister. Typically, the rupturable layer is located adjacent the nonrupturable layer to seal the opening in the nonrupturable layer. The blister package may also include indicia associated with the blisters to help insure compliance with complex therapeutic regimens. The blister package may also include fold lines to help reduce the overall size of the blister package; thereby making it easier to transport.

20 Claims, 4 Drawing Sheets

DUAL CHAMBER-CHILD RESISTANT BLISTER PACKAGE

This is a continuation of application Ser. No. 08/069,309, filed on May 28, 1993, now abandoned.

BACKGROUND OF THE INVENTION

1. Field of the Invention

The present invention relates to blister packages for medicaments; and more particularly, to such blister packages which are child-resistant.

2. Description of the Prior Art

Medicaments are commonly marketed in blister packages. Blister packages typically have a thermoformed blister layer which is generally planar except in the areas where blisters are formed. Adhered to the underside (i.e., the side away from the blister formations) of the thermoformed layer is a rupturable layer which is utilized to seal a medicament within the blister. To remove a medicament from the package, a force is applied to the blister which forces the medicament through the rupturable layer, thereby freeing the medicament from the package. Unfortunately, such blister packages are not child-resistant.

Various approaches have been utilized to render blister packages for medicaments child-resistant. Typically, a non-rupturable layer is laminated to the blister layer such that it prevents the medicament from being forced through the rupturable layer until the non-rupturable layer is rendered ineffective.

One common approach to rendering the nonrupturable layer ineffective is to enable the nonrupturable layer to be peeled from the blister package. Peeling of the nonrupturable layer is often enabled by extending the nonrupturable layer past the blister layer such that a grasping tab is provided. Alternatively, peeling is often enabled by including a line of weakness in the blister layer such that upon breaking the blister layer along the line of weakness a grasping tab is provided.

Another common approach to rendering the nonrupturable layer ineffective involves utilizing an oriented film for the rupturable layer which, although being resistant to rupturing, is relatively easily torn in the direction of orientation. A slit is typically included through the blister package such that the package can be torn through the blister releasing the medicament.

SUMMARY OF THE INVENTION

In accordance with one aspect of the present invention a child-resistant blister package for housing a medicament is provided. The package includes a blister layer which has a blister projecting from one face thereof. Each blister has a storage chamber and a discharge chamber. A nonrupturable means is disposed adjacent the storage chamber of the blister for preventing a medicament from being discharged from the storage chamber through the nonrupturable means. A rupturable means is disposed adjacent the discharge portion of the blister for enabling the medicament to be discharged from the storage chamber. A restraint means is also included for preventing the medicament from moving from the storage chamber to the discharge chamber until a predetermined force is applied to the blister package.

In accordance with a second aspect of the present invention a child-resistant blister package for housing a medicament is provided wherein the nonrupturable means is a nonrupturable layer which includes an opening located adjacent the discharge chamber of the blister sized to permit the medicament to pass through the opening. Additionally, the rubturable means is a rupturable layer disposed adjacent the discharge portion of the blister, covering the opening of the nonrupturable layer and sealing the medicament in the blister. Thus, once the medicament is located in the discharge chamber, the medicament can be discharged from the package upon application of a force which ruptures the rupturable layer and pushes the medicament through the opening of the nonrupturable layer.

In accordance with a third aspect of the present invention a child-resistant blister package for housing a medicament is provided wherein the nonrupturable means is a nonrupturable layer and the rupturable means is a score line extending partially through the nonrupturable layer such that the medicament may be manually pushed out through an opening in the nonrupturable layer created along the score line as a force is applied to the blister.

BRIEF DESCRIPTION OF THE DRAWINGS

While the specification concludes with claims which particularly point out and distinctly claim the invention, it is believed the present invention will be better understood from the following description of a preferred embodiments taken in conjunction with the accompanying drawings, in which like reference numerals identify identical elements and wherein;

DESCRIPTION OF THE PREFERRED EMBODIMENT

Figure 1:
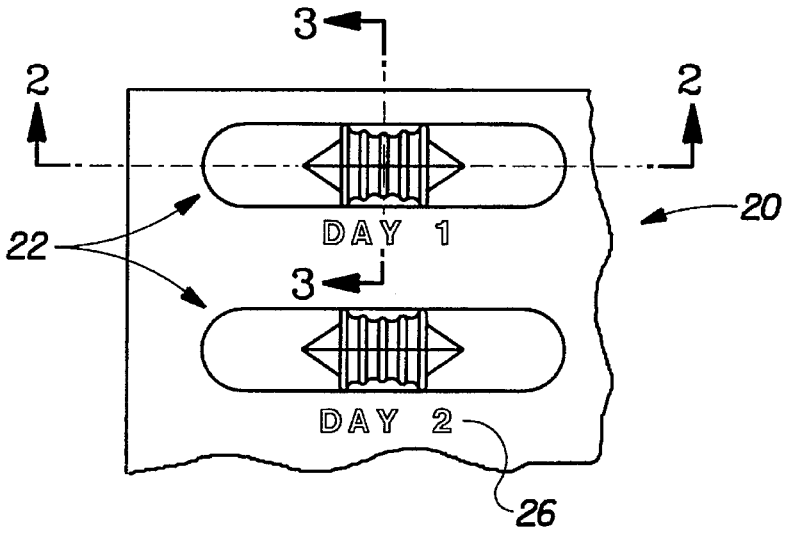
FIG. 1 is a fragmentary top plan view of a preferred blister package of the present invention with the medicament in the storage chamber.

In a preferred embodiment shown in FIGS. 1 through 4, the present invention provides a dual chamber—child-resistant blister package, indicated generally as 20. The blister package 20 may include many blisters 22 and the blisters 22 may house a plurality of different types of medicaments 24 (seen in FIG. 2). Furthermore, the blister package 20 may include indicia 26, such as day indications, which help insure compliance with complex therapeutic regimens. Such complex therapeutic regimens require that different types of medicaments be taken on different days or at different times of the day. The blister package 20 may accommodate an extended therapeutic regimen by having fold lines (not seen) which permit the overall dimensions of the blister package 20 to be reduced by folding the package 20, permitting it to be more easily carried.

Figure 2:
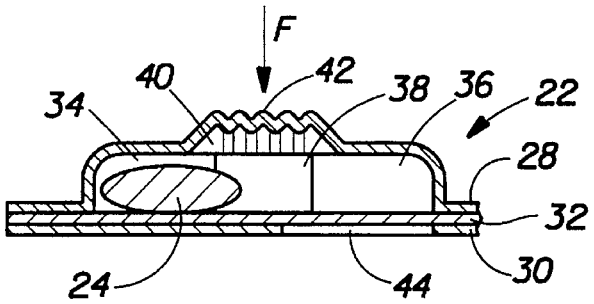
FIG. 2 is a cross-sectional view taken along line 2—2 of FIG. 1.
Figure 3:
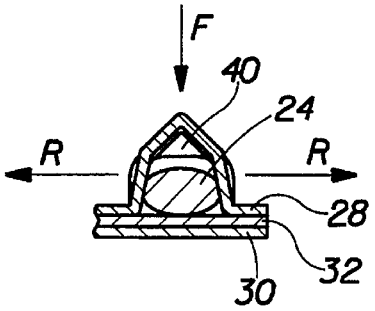
FIG. 3 is a cross-sectional view taken along line 3—3 of FIG. 1.

Referring to FIG. 2, the package 20 generally includes a blister layer 28, a nonrupturable means, a rupturable means, and restraint means. The blister layer 28 is preferably thermoformed to have a plurality of blisters 22 in one face thereof. The blister layer 28 may be made from thermoplastic polymeric materials, including polyvinylchloride (homopolymer or copolymer), polyester, polypropylene, fluorocarbon polymers, copolymers and terpolymers, laminates and coatings of such materials, and such materials having modifying components like plasticizers therein. Each blister 22 includes two chambers; a storage chamber 34 and a discharge chamber 36. Each chamber, 34 and 36, is capable of housing a medicament 24. The blister 22 includes a narrowed portion 38, separating the storage chamber 34 from the discharge chamber 36 and giving the blister 22 an hour glass shape. The dimensions of the narrowed portion 38 are such that a medicament 24 cannot pass through the narrowed portion 38 when the narrowed portion 38 is in its rest position.

The blister 22 also includes an elongated pyramid portion 40 protruding above the narrowed portion 38. The elongated pyramid portion 40 includes raised ribs 42. The term "ribs" as utilized herein is intended not only to include the illustrated elongated undulations 42, but also to include any structural detail which provides rigidity to the blister 22. Together, the narrowed portion 38 and the raised elongated pyramid portion 40 serve as restraint means for preventing the medicament from moving from the storage chamber 34 to the discharge chamber 36 until a predetermined force is applied to the blister package 22, as discussed below.

The nonrupturable means of this embodiment is a nonrupturable layer 30 is located adjacent each blister 22 preventing a medicament 24 located within the storage chamber 34 from being discharged from the storage chamber 34 through the nonrupturable layer 30. The term "adjacent" as used herein is intended to conote next to, but not necessarily immediately next to. Thus, the nonrupturable layer 30 is adjacent the blister layer 28 even though the rupturable layer 32 is located between the blister layer 28 and the nonrupturable layer 30.

The nonrupturable layer 30 includes an opening 44 located adjacent each discharge chamber 36 permitting a medicament 24 located within the discharge chamber 36 to be discharged from the package 20 through the opening 44 of the nonrupturable layer 30. Although the term "opening" is used herein it is merely intended to connote that the nonrupturable layer 30 is absent from the location adjacent the discharge chamber 36 of the blister 22. In addition, although the phrase "nonrupturable layer" is utilized herein, it is intended to connote that manually applying a force to the medicament 24 will not push the medicament 24 through the nonrupturable layer 30 (although the nonrupturable layer 30 may be ruptured utilizing a sharp object).

The rupturable means of this embodiment is a rupturable layer 32 located adjacent the nonrupturable layer 30; sealing the opening 44 in the nonrupturable layer 30; thereby sealing the medicament 24 within the blister 22. In an alternative embodiment (not seen), the rupturable layer 32 may be located adjacent the nonrupturable layer, but exterior of the nonrupturable layer. In an additional alternative embodiment (not seen), the rupturable layer 32 may be located within the blister 22 between the storage chamber 34 and the discharge chamber 36. In any case, the rupturable layer 32 and/or the blister layer 28 may be made of a material which provides barrier properties.

To remove a medicament 24 from a blister 22 a predetermined force in the direction of the arrow F seen in FIG. 2 is applied to the elongated pyramid portion 40 protruding from the blister 22. The ribs 42 add strength to the pyramid portion 40 and help transfer the force F to the sides of the blister 22 at the narrowed portion 38 of the blister 22. Thus, the force F causes the opposing sides of the narrowed portion 38 to move outwardly in opposing directions (i.e., the direction of the arrows R of FIG. 3), enlarging the transverse dimension of the blister 22. The material from which the blister layer 28 is made (taking into consideration its structure) must be strong enough to withstand the force F without collapsing and flexible enough to permit the side walls of the narrow portion 38 to move outwardly.

Additionally, although the reasons are not understood, it has been found that the utilization of a sheet material which has a plasticizer included therein to make the blister layer 28 provides improved performance. The blister 22 seems to be stonger, less prone to collapsing and better able to bend as appropriate upon application of the force F to the blister 22.

Figure 4:
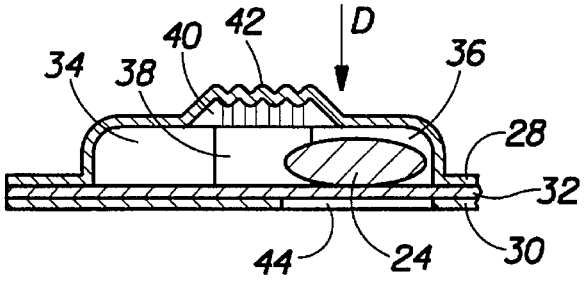
FIG. 4 is a cross-sectional view similar to FIG. 2 with the medicament in the discharge chamber.
Figure 5:
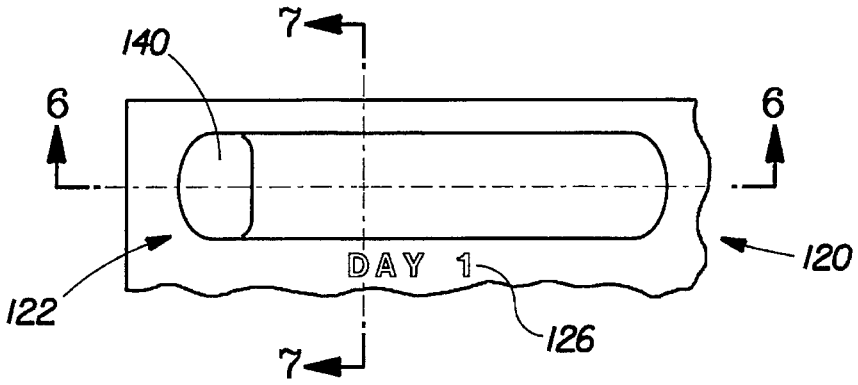
FIG. 5 is a fragmentary top plan view of an alternative preferred blister package of the present invention with the medicament in the storage chamber.

With the force F applied expanding the narrowed portion 38, the medicament 24 is then free to pass through the narrowed portion 38 and into the discharge chamber 36 from the storage chamber as seen in FIG. 4. By tipping the package 20, gravity can be permitted to act upon the medicament 24 to move the medicament 24 from the storage chamber 34 through the outwardly expanded narrowed portion 38 and into the discharge chamber 36. Consequently, the elongated pyramid portion 40 and the narrowed portion 38 operate as restraint means for preventing the medicament 24 from moving from the storage chamber 34 to the discharge chamber 36 until a predetermined force is applied to the blister package 20.

Once the medicament 24 is located in the discharge chamber 36 of the blister 22, a discharge force D in the direction of the arrow D of FIG. 4 is applied to the blister 22. This force D is transferred to the medicament 24 through the blister 22 which causes the medicament 24 to rupture the rupturable layer 32 and pass through the opening 44 in the nonrupturable layer 30. Thus, the medicament 24 is discharged from the package 20 in a two step process.

An exemplary dual chamber—child resistant blister package 20 of the present invention as illustrated in FIGS. 1 through 4, could include a blister layer 28 thermoformed with a plurality of dual chamber blisters 22 formed in one face thereof from a layer of PVCA which may be purchased from Arlington Mills, Arlington Heights, Ill., having an original thickness (i.e., before thermoforming) of about 0.015 inch. The blisters 22 may have an overall width of about 0.25 inch, an overall length of about 1.0 inch, and an overall height of about 0.19 inch (excluding the pyramid portion 40 and excluding other layers, 30 and 32). The narrowed portion 38 of the blister may be about 0.185 inch long and have an internal transverse dimension of about 0.23 inch at the bottom and a draft angle of about 15° toward the top of the side wall. The dimensions of the elongated pyramid portion 40 atop the blister 22 may generally be about 0.05 inch in overall height and about 0.42 inch in overall length. The dual chamber blister 22 may be adapted to function with a medicament 24 having an overall length of about 0.46 inch, and overall height of about 0.16 inch and overall width of about 0.23 inch. The rupturable layer 32 is made of foil and has a thickness of about 0.0015 inch. The nonrupturable layer 30 is made of a laminate of foil, paperboard and polyester with an overall thickness of about 0.004 inch.

Referring to FIGS. 5 through 8, an alternative preferred dual chamber—child resistant blister package 120 of the present invention is illustrated. The blister 122 of this package 120 includes two semi spherical projections 138 which protrude inwardly into the blister 122 separating the storage chamber 134 from the discharge chamber 136 which operates as restraint means for preventing the medicament 124 from moving from the storage chamber 134 to the discharge chamber 136 until a predetermined force is applied to the blister package 120 as described below.

The distal end of the storage chamber 134 of the blister 122 includes a sloped wall 140. The discharge chamber 136 is elongated which helps improve child resistance as described below. The rupturable means and the nonrupturable means of this embodiment are similar to those of the previous embodiment; i.e., a rupturable layer 132 and a nonrupturable layer 130. The rupturable layer 132 is located immediately adjacent the blister layer 128, sealing the medicament 124 within the blister 122 and sealing the opening 144 of the nonrupturable layer 130. The nonrupturable layer 130 is located adjacent the storage chamber 134, preventing a medicament 124 located within the storage chamber 134 from being discharged from the storage chamber 134 through the nonrupturable layer 130. The nonrupturable layer 130 includes an opening 144 located adjacent the distal end of each discharge chamber 136 permitting a medicament 124 located within the discharge chamber 136 to be discharged from the package 120 through the opening 144 of the nonrupturable layer 130 once the medicament 124 is located over the opening 144. Locating the opening 144 of the nonrupturable layer 130 at the distal end of the discharge chamber 136 increases child-resistance, since the medicament 124 must be manipulated to the location in the discharge chamber 136 over the opening 144 before the medicament 124 can be discharged from the package 120.

Figure 6:
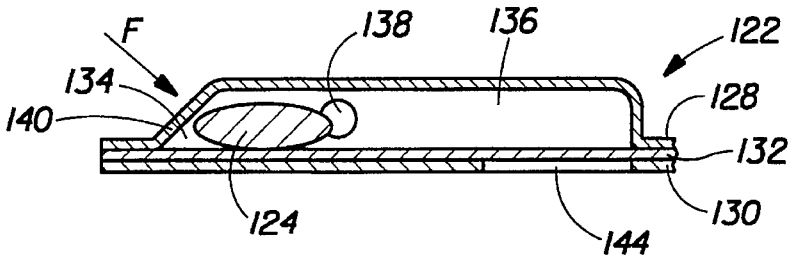
FIG. 6 is a cross-sectional view taken along line 6—6 of FIG. 5.
Figure 7:
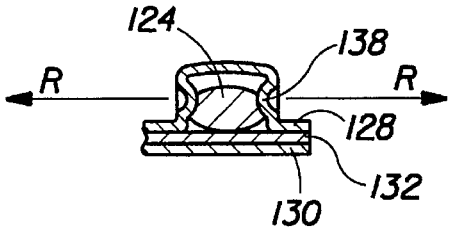
FIG. 7 is a cross-sectional view taken along line 7—7 of FIG. 5.
Figure 8:
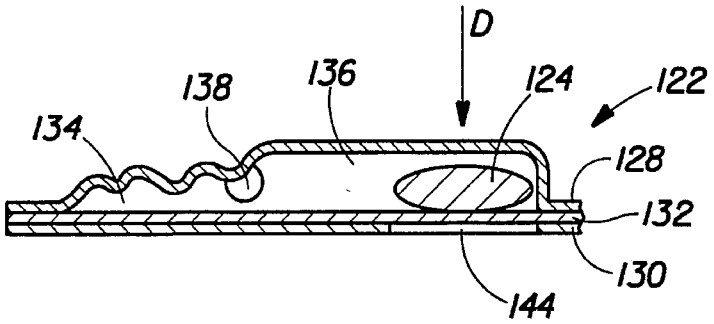
FIG. 8 is a cross sectional view similar to FIG. 6 with the medicament in the discharge chamber.
Figure 9:
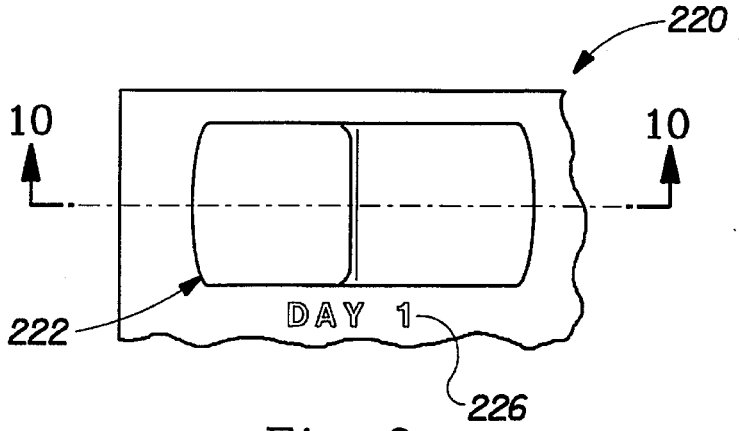
FIG. 9 is a fragmentary top plan view of another alternative preferred blister package of the present invention with the medicament in the storage chamber.

To remove a medicament 124 from the child-resistant blister package 120 a force F in the direction of the arrow F of FIG. 6 is applied to the blister 122. This force F is transferred through the blister 122 to the medicament 124 forcing the medicament 124 in the direction of the discharge chamber 136 (since the medicament 124 cannot be pushed through the nonrupturable layer 130 adjacent the storage chamber 134). As the medicament 124 moves toward the discharge chamber 136, the medicament 124 pushes against the two projections 138 forcing the sides of the blister 122 to expand outwardly in the opposing directions of the arrows R of FIG. 7. The force F is gradually moved down the storage chamber 134 of the blister 122; crushing and permanently deforming the storage chamber 122 and pushing the medicament 124 past the projections 138 and into the discharge chamber 136. Once in the discharge chamber 136, gravity may be utilized to locate the medicament 124 over the opening 144 of the non rupturable layer 130. Alternatively, the same force F may be further moved down the blister 122, crushing the discharge chamber 136 and locating the medicament 124 over the opening 144. Then a force D, as seen in FIG. 8, is applied to the discharge chamber 136 of the blister layer 128 forcing the medicament 124 through the opening 144, rupturing the rupturable layer 132.

Referring to FIGS. 9 through 12, another alternative preferred blister package 220 of the present invention is illustrated. This embodiment is adapted to house two medicaments 224 per blister 222. The storage chamber 234 has a sloping top wall and the discharge chamber 236 has a relatively horizontal top wall; these two walls are joined by a substantially vertical wall 238. In addition to the blister layer 228 being thermoformed, the nonrupturable means is a thermoformed layer 230. The nonrupturable layer 230 includes a sloping wall and a vertical wall 240 corresponding generally to the sloping top wall and vertical wall 238 of the blister layer 228; giving the nonrupturable layer 230 a generally similar shape to the top wall of the blister 222 and preventing the medicaments 224 from being discharged through the nonrupturable layer 230 from the storage chamber 234. Together the sloping wall and vertical wall 240 of the nonrupturable layer 230 and the vertical wall 238 of the blister layer 228 operate as restraint means for preventing the medicaments 224 from moving from the storage chamber 234 to the discharge chamber 236 until a predetermined force is applied to the blister package 220 as described below.

The rupturable means of this embodiment is a score line 232 in the nonrupturable layer 230 which has a generally "U" shape. The score line 232 extends partially through the nonrupturable layer 230 such that the nonrupturable layer 230 seals the medicament 224 within the blister 222, and such that the medicament 224 may be manually pushed out through the nonrupturable layer 230 from the discharge chamber 236 as described below.

Figure 10:
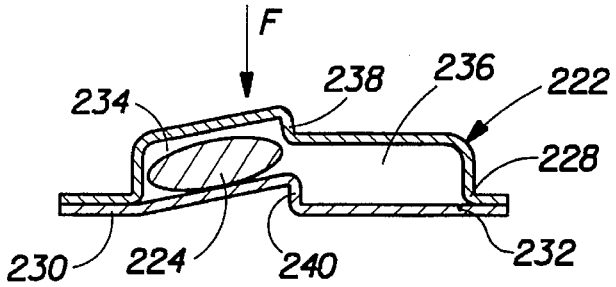
FIG. 10 is a cross-sectional view taken along line 10—10 of FIG. 9.

To remove a pair of medicaments 224 from a blister 222 a force F, as seen in FIG. 10, is applied to the storage chamber 234 of the blister 222. This force F is transferred to the medicaments 224 which crush the vertical wall 240 of the nonrupturable layer 230, permanently deforming the wall 240. This permits the medicaments 224 to pass below the vertical wall 238 of the blister 222 and move into the discharge chamber 236 under the force of gravity.

Figure 11:
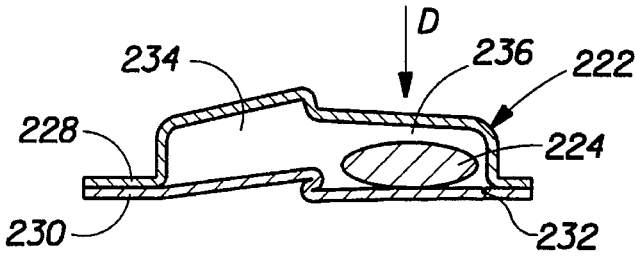
FIG. 11 is a cross-sectional view similar to FIG. 10 with the medicament in the discharge chamber.
Figure 12:
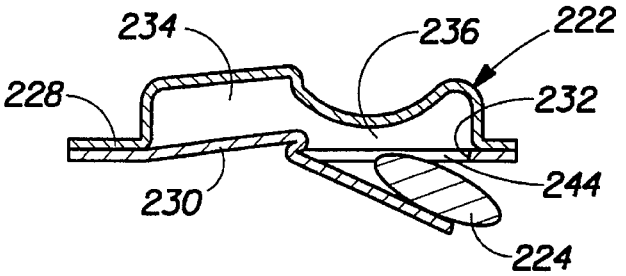
FIG. 12 is a cross-sectional view similar to FIG. 10 with the medicament being discharged from the discharge chamber.
Figure 13:
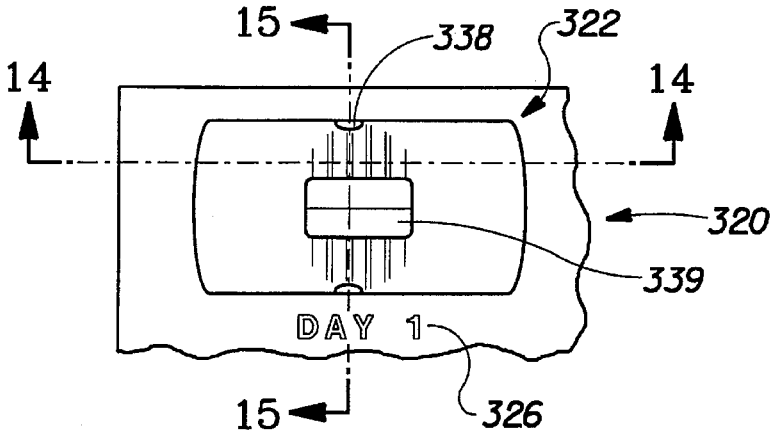
FIG. 13 is a fragmentary top plan view of an additional alternative preferred blister package of the present invention with the medicament in the storage chamber.

Once in the discharge chamber 236 a force D, as seen in FIG. 11, is applied to the discharge chamber 236 of the blister 222 which forces the medicaments 224 against the nonrupturable layer 230 within the bounds of the "U" shaped score line 232. As the medicaments 224 are forced against the nonrupturable layer 230 adjacent the score line 232, the nonrupturable layer 230 separates along the score line 232 creating an opening 244 in the nonrupturable layer 230. The medicaments 224 are then free to pass through the nonrupturable layer 230 via the opening 244.

Referring to FIGS. 13 through 16, an additional alternative preferred blister package 320 of the present invention is illustrated. The blister 322 of this package 320 includes two semi spherical projections 338 which protrude inwardly into the blister 322 separating the storage chamber 334 from the discharge chamber 336, seen best in FIG. 15. The blister 322 includes ribs 340 which help transmit the force F, seen in FIG. 14, to the side walls of the blister 322; thereby moving the projections 338 outwardly similar to the embodiment of FIG. 1. Thus, the semi spherical projections 338 operate as restraint means for preventing the medicaments 324 from moving from the storage chamber 334 to the discharge chamber 336 until a predetermined force is applied to the blister package 320 as described below. The ribs 340 are located partially on an arcuate surface which also helps add structural rigidity to the top wall of the blister 322.

In addition, the central portion of the blister 322 includes a projection 339 depending from the top of the blister 322. The nonrupturable layer 330 is also a thermoformed layer which includes a series of elongated ridges, 331 and 333, which operate, in conjunction with the depending projection 339 of the blister 322, to hold the medicaments 324 in appropriate alignment within the storage chamber 334. The nonrupturable layer 330 is located immediately adjacent the blister layer 328 preventing medicaments 324 located within the storage chamber 334 from being discharged from the storage chamber 334 through the nonrupturable layer 330. The rupturable layer 332 is adhered to the nonrupturable layer 330, covering the opening 344 of the non rupturable layer 330 and sealing the medicaments 324 within the blister 322.

Figure 14:
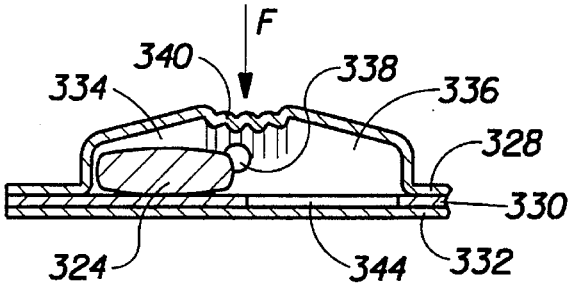
FIG. 14 is a cross-sectional view taken along line 14—14 of FIG. 13.
Figure 15:
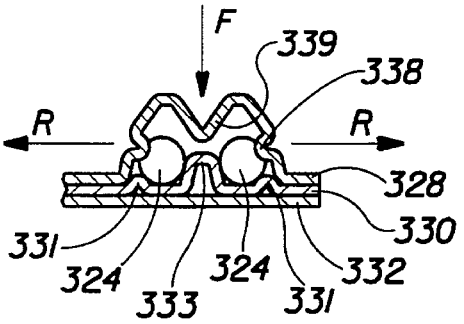
FIG. 15 is a cross-sectional view taken along line 15—15 of FIG. 13.

To remove a pair of medicaments 324 from a blister 322 a force F, as seen in FIG. 14, is applied to the blister 322. The arcuate portion of the blister 322 with its ribs 340 add strength to the blister layer 328 and help transfer the force F to the side walls of the blister 322 moving the semi spherical projections 338 on the side walls of the blister 322 in opposing directions as indicated by the arrows R of FIG. 15. Thus, the force F causes the sides of the blister 322, and consequently the semi spherical projections 338 to move outwardly enlarging the transverse dimension of the blister 322.

With the force F applied, the medicaments 324 are then free to pass the semi spherical projections 338 into the discharge chamber 336 from the storage chamber 334. By tipping the package 320, gravity can be permitted to act upon the medicaments 324 to move the medicaments 324 from the storage chamber 334 into the discharge chamber 336. Consequently, the semi spherical projections 338 in combination with the arcuate, ribbed 340 part of the blister 322 operate as restraint means for preventing the medicaments 324 from moving from the storage chamber 334 to the discharge chamber 336 until a predetermined force is applied to the blister package 320.

Figure 16:
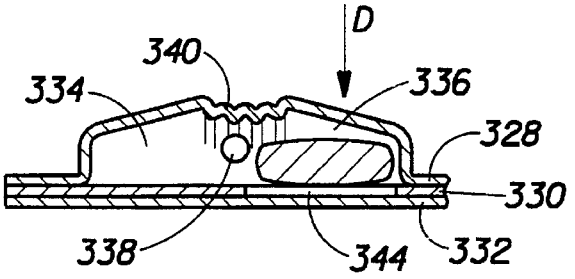
FIG. 16 is a cross-sectional view similar to FIG. 14 with the medicament in the discharge chamber.

Once the medicaments 324 are located in the discharge chamber 336 of the blister 322, a discharge force D is applied to the blister 322 as seen in FIG. 16. This force D is transferred to the medicaments 324 and causes the medicaments 324 to rupture the rupturable layer 332 and pass through the opening 344 in the nonrupturable layer 330. Thus, the medicaments 324 are discharged from the package in a two step process.

An exemplary embodiment of the blister package 320 of the present invention as illustrated in FIGS. 13 through 16, could include a blister layer 328 thermoformed with a plurality of dual chamber blisters 322 in one face thereof from a layer of polyvinylchloride having an original thickness (i.e., before thermoforming) of about 0.015 inch. The blisters 322 may have an overall width of about 0.9 inch, an overall length of about 1.6 inches, and an overall height of about 0.54 inch. The arcuate part of the blister 322 may have a radius of about 0.19 inch. The depending projection 339 of the blister 322 may extend about 0.21 inch down, be about 0.17 inch wide and about 0.42 inch in long. The semi spherical projections 338 may have a diameter of about 0.15 inch.

The nonrupturable layer 330 is thermoformed from a layer of polyvinylchloride having an original thickness (i.e., before thermoforming) of about 0.015 inch. The overall dimensions of the outer elongated ridges 331 of the nonrupturable layer 330 may be about 0.07 inch in height, about 0.1 inch in width and about 0.48 inch in length. The overall dimensions of the central elongated ridge 333 of the nonrupturable layer 330 may be about 0.19 inch in height (excluding the other layers, 328 and 332), about 0.275 inch in width and about 1.1 inch in length. The dual chamber blister 322 is adapted to function with medicaments 324 having an overall length of about 0.8 inch, and overall height of about 0.36 inch and overall width of about 0.36 inch. The rupturable layer 332 is a foil layer about 0.0015 inch in thickness.

Although particular embodiments of the present invention have been illustrated and described, modifications may be made without departing from the teachings of the present invention. Accordingly, the present invention comprises all embodiments within the scope of the appended claims.

What we claim is:

1. A child-resistant blister package housing a medicament comprising:

(a) a blister layer having a blister projecting from one face thereof, the blister having a storage chamber and a discharge chamber;

(b) nonrupturable means disposed adjacent the storage chamber of the blister for preventing the medicament from being discharged from the storage chamber through the nonrupturable means;

(c) rupturable means disposed adjacent the discharge chamber of the blister for enabling the medicament to be discharged from the discharge chamber, the rupturable means being structurally different from the nonrupturable means so that a minimum force acting upon the rupturable means to cause the rupturable means to rupture is less than a minimum force acting upon the nonrupturable means to cause the nonrupturable means to rupture; and (d) restraint means for preventing the medicament from moving from the storage chamber to the discharge chamber until a predetermined force is applied to the blister package and for allowing the medicament to move from the storage chamber to the discharge chamber once the predetermined force is applied to the blister package.

2. A child-resistant blister package housing a medicament according to claim 1, wherein the predetermined force is transferred to the medicament through the blister layer, forcing the medicament against the restraint means, moving the restraint means such that the medicament can pass from the storage chamber to the discharge chamber.

3. A child-resistant blister package housing a medicament according to claim 1, wherein the predetermined force is applied to the blister to deform the blister to move the restraint means and permit the medicament to pass from the storage chamber to the discharge chamber.

4. A child-resistant blister package housing a medicament according to claim 3, wherein the blister includes at least one rib therein which provides increased structural integrity to the blister such that the blister deforms to move the restraint means and permit the medicament to pass into the discharge chamber from the storage chamber as the predetermined force is applied to the blister package.

5. A child-resistant blister package housing a medicament according to claim 4, wherein, upon locating the medicament within the discharge chamber, the discharge chamber is larger than required to house the medicament and the rupturable means is non-functional unless the medicament is placed in a predetermined location within the discharge chamber; thereby requiring placement of the medicament within the predetermined location after the medicament is moved into the discharge chamber before the rupturable means will function.

6. A child-resistant blister package housing a medicament according to claim 4, further comprising indicia associated with the blister to help insure compliance.

7. A child-resistant blister package housing a medicament according to claim 1, wherein, upon locating the medicament within the discharge chamber, the discharge chamber is larger than required to house the medicament and the rupturable means is non-functional unless the medicament is placed in a predetermined location within the discharge chamber; thereby requiring placement of the medicament within the predetermined location after the medicament is moved into the discharge chamber before the rupturable means will function.

8. A child-resistant blister package housing a medicament according to claim 1, further comprising indicia associated with the blister to help insure compliance.

9. A child-resistant blister package housing a medicament according to claim 1, wherein:

(a) the nonrupturable means is a nonrupturable layer; and (b) the rupturable means is a score line extending partially through the nonrupturable layer such that the medicament may be manually pushed out through an opening in the nonrupturable layer created along the score line as a force is applied to the blister.

10. A child-resistant blister package housing a medicament according to claim 9, wherein the predetermined force is transferred to the medicament through the blister layer, forcing the medicament against the restraint means, moving the restraint means such that the medicament can pass from the storage chamber to the discharge chamber.

11. A child-resistant blister package housing a medicament according to claim 9, wherein the predetermined force is applied to the blister to deform the blister to move the restraint means and permit the medicament to pass from the storage chamber to the discharge chamber.

12. A child-resistant blister package housing a medicament according to claim 11, wherein the blister includes at least one rib therein which provides increased structural integrity to the blister such that the blister deforms to move the restraint means and permit the medicament to pass into the discharge chamber from the storage chamber as the predetermined force is applied to the blister package.

13. A child-resistant blister package housing a medicament according to claim 12, further comprising indicia associated with the blister to help insure compliance.

14. A child-resistant blister package housing a medicament according to claim 12, wherein the discharge chamber is larger than required to house the medicament and the opening in the nonrupturable layer is smaller than the discharge chamber; thereby requiring placement of the medicament above the opening in the nonrupturable layer after it is moved into the discharge chamber.

15. A child-resistant blister package housing a medicament comprising:

(a) a blister layer having a blister projecting from one face thereof, the blister having a storage chamber and a discharge chamber;

(b) nonrupturable means disposed adjacent the storage chamber of the blister for preventing the medicament from being discharged from the storage chamber through the nonrupturable means, the nonrupturable means being a nonrupturable layer including an opening located adjacent the discharge chamber of the blister sized to permit the medicament to pass through the opening;

(c) rupturable means disposed adjacent the discharge chamber of the blister for enabling the medicament to be discharged from the discharge chamber by application of a force which is less than a force that would be required to rupture the nonrupturable means, the rupturable means being a rupturable layer disposed adjacent the discharge portion of the blister covering the opening of the nonrupturable layer and sealing the medicament in the blister; and (d) restraint means for preventing the medicament from moving from the storage chamber to the discharge chamber until a predetermined force is applied to the blister package and for allowing the medicament to move from the storage chamber to the discharge chamber once the predetermined force is applied to the blister package.

16. A child-resistant blister package housing a medicament according to claim 15, wherein the predetermined force is transferred to the medicament through the blister layer, forcing the medicament against the restraint means, moving the restraint means such that the medicament can pass from the storage chamber to the discharge chamber.

17. A child-resistant blister package housing a medicament according to claim 15, wherein the predetermined force is applied to the blister to deform the blister to move the restraint means and permit the medicament to pass from the storage chamber to the discharge chamber.

18. A child-resistant blister package housing a medicament according to claim 17, wherein the blister includes at least one rib therein which provides increased structural integrity to the blister such that the blister deforms to move the restraint means and permit the medicament to pass into the discharge chamber from the storage chamber as the predetermined force is applied to the blister package.

19. A child-resistant blister package housing a medicament according to claim 18, further comprising indicia associated with the blister to help insure compliance.

20. A child-resistant blister package housing a medicament according to claim 18, wherein the discharge chamber is larger than required to house the medicament and the opening in the nonrupturable layer is smaller than the discharge chamber; thereby requiring placement of the medicament above the opening in the nonrupturable layer after it is moved into the discharge chamber.

* * * * *